US006565173B1

(12) United States Patent
Murcia et al.

(10) Patent No.: US 6,565,173 B1
(45) Date of Patent: May 20, 2003

(54) THERMAL INKJET PRINTER APPARATUS AND METHOD

(75) Inventors: Antoni Murcia, San Diego, CA (US); Matthew W. Scuri, Meridian, ID (US); Juan Carlos Vives, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 50 days.

(21) Appl. No.: 09/665,572

(22) Filed: Sep. 19, 2000

(51) Int. Cl.[7] ..... B41J 29/13; B41F 17/00

(52) U.S. Cl. ..... 347/9; 347/108; 101/35

(58) Field of Search ..... 347/37, 9, 104; 101/35; 400/82, 124, 27, 268, 355, 232, 61, 70, 88

(56) References Cited

U.S. PATENT DOCUMENTS

| | | | | |
|---|---|---|---|---|
| 3,641,930 A | | 2/1972 | Riddington | 101/35 |
| 3,702,000 A | | 10/1972 | Delligatti | 346/92 |
| 3,831,728 A | | 8/1974 | Woods et al. | 197/1 R |
| 3,968,498 A | * | 7/1976 | Uchiyama | 347/37 |
| 5,119,109 A | | 6/1992 | Robertson | 347/2 |
| 5,423,617 A | | 6/1995 | Marsh et al. | 400/82 |
| 5,428,375 A | | 6/1995 | Simon et al. | 347/12 |
| 5,838,346 A | * | 11/1998 | Stemmle, Sr. | 347/37 |
| 6,082,854 A | * | 7/2000 | Axtell et al. | 347/108 |
| 6,113,232 A | | 9/2000 | Belon et al. | 347/104 |
| 6,155,680 A | | 12/2000 | Belon et al. | 347/104 |

FOREIGN PATENT DOCUMENTS

JP 61041561 A * 2/1986 ..... B41J/3/10

OTHER PUBLICATIONS

Epson Webpage: PL–1000; Feb. 11, 2002.

* cited by examiner

*Primary Examiner*—John Barlow
*Assistant Examiner*—Alfred Dudding

(57) ABSTRACT

A fast and economical thermal inkjet printer prints on elongate print media, such as on a strip of paper from a roll, by moving a fluid jet print cartridge a determined dimension longitudinally of the length dimension of the paper strip while printing. In order to print a document that is wider than the width the print cartridge can print in a single scan of the paper, the cartridge is dithered among selected lateral positions within the width of the paper strip, and successively is scanned lengthwise of the paper strip to print in each successive longitudinal printing "swath." A capstan of the printer advances the paper strip in steps of unit dimension along the length of the paper strip, which unit dimension may be substantially equal to the determined dimension of print cartridge movement while printing, so that documents having a length greater than the determined dimension can be printed in successive parts each of a length equal to this unit dimension. The capstan can also selectively advance the paper strip by a dimension that is less than the unit dimension so that documents printed on the printer may have lengths other than multiples of the determined dimension, thus saving on paper use.

15 Claims, 3 Drawing Sheets

THERMAL INKJET PRINTER APPARATUS AND METHOD

BACKGROUND OF THE INVENTION

1. Field of the Invention

Figure 1:
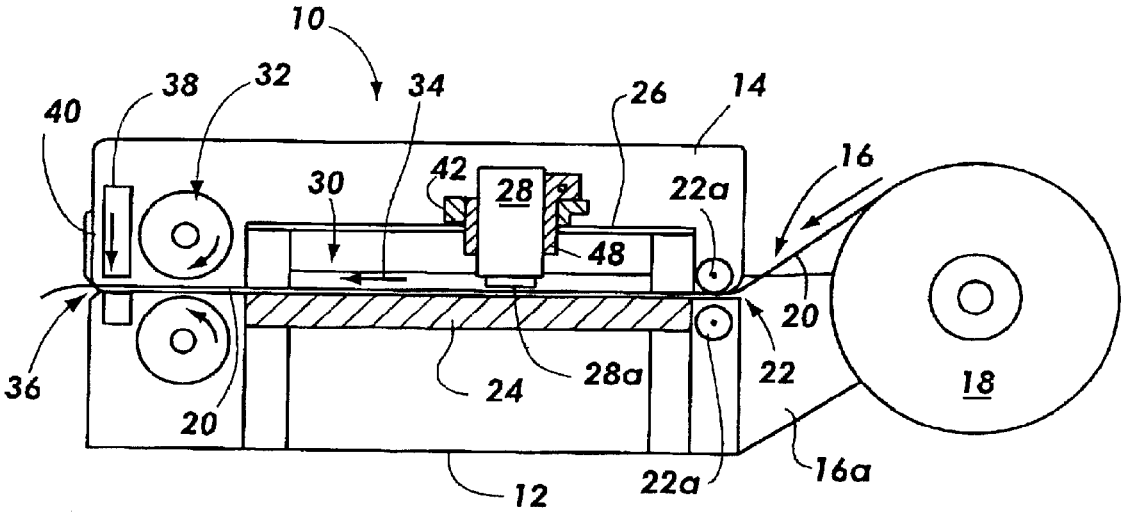

This invention relates generally to thermal inkjet printing. More particularly, this invention relates to an economical, low-cost thermal inkjet printer having a path for print media (e.g., paper or plastic printing film) advancement, and which defines a media advance direction. The printer also includes an inkjet printing cartridge. During a printing interval the inkjet printing cartridge controllably ejects droplets of printing fluid (i.e., ink, for example) onto the print media from a generally linear array of printing orifices. During this printing interval the printing cartridge is controllably moved in a direction parallel with the media advance direction and generally perpendicular to the length of the linear array of printing orifices in order to print in a "swath" on the media. Between printing intervals, the print media may be advanced in step-wise fashion along the media advancement path, or the printing cartridge may be shifted laterally of the media advance direction, or stepped among plural printing positions for the printing cartridge, or both.

2. Related Technology

One form of conventional thermal inkjet printer or plotter typically has a print cartridge mounted on a movable carriage. This carriage is traversed back and forth across the width of a print media (i.e., usually paper or a plastic plotting film, for example) as the print media is fed through the printer or plotter. Plural orifices on a print head of the print cartridge are fed ink (or other printing fluid) by one or more channels communicating from a reservoir of the print cartridge. Energy applied individually to addressable resistors (or to other energy-dissipating elements, for example, to piezoelectric actuators), transfers energy to ink or other printing fluid at the print head; which ink (printing fluid other than ink hereinafter being subsumed also in the term "ink") is within or associated with selected ones of the plural orifices. These orifices then eject a part of the ink onto the printing media. The ejected ink forms a fine-dimension jet or stream that impinges on the printing media at a selected location dependent upon the relative positions of the print media and of the selected orifice(s) from which ink is ejected.

Another form of conventional thermal inkjet printer has a media transport mechanism that controllably moves print media past an array of plural print cartridges, each with a respective print head. In this type of inkjet printer, the print cartridges are arrayed in a stationary array, usually of "block wall" arrangement, or in a diagonally arrayed and slightly overlapped arrangement, so that the entire width of the print media (or of that portion of the print media on which printing is to be done) passes by the print heads as the media is controllably moved through the printer.

With each type of conventional thermal inkjet printer mentioned above, the print media transport mechanism must be able to move and position the print media with high precision. The first type of conventional thermal inkjet printer or plotter must also have a highly precise mechanism for moving the carriage carrying the inkjet print cartridge relative to the print media. In each case, the resolution or precision of the characters or images produced by the printer is highly dependent upon the precision of the print media advance mechanism, and possibly also on the precision of the print cartridge scanning mechanism. For this reason, printers of these conventional types have had a relatively high cost.

However, there are several thermal inkjet printing applications in which high resolution or precision of images and characters are of secondary importance. Such applications include the printing of retail transaction receipts, the printing of credit card and debit card transaction receipts, and the printing of ATM machine receipts, for example. In each case, the document or receipt printed is strictly a utility document, and will likely have a short useful life. In many cases the recipient of the printed document merely glances at it to confirm a transaction just completed, and then immediately discards the paper document. In other cases, the receipt or transaction record documents are kept only until a monthly statement is received from the credit card company. Thus, after the transaction receipts and monthly statement are compared, the receipts are all discarded. In such high-volume printing applications, a low cost and high speed of production for the printed document is of far greater importance that is the precision or resolution of the printing on the document. While such documents must be legible, high quality printing and image presentation is not required.

Despite the above, it is common in conventional printers for printing such low-resolution documents and receipts to employ of printer of the first type described above. That is, the printer includes a print cartridge mounted on a movable carriage. This carriage is traversed back and forth across the width of a print media, which may be a comparatively narrow strip of paper still attached to a roll of paper as the paper is fed through the printer or plotter, for example. Relatively high precision is required for both the traverse mechanism carrying the print cartridge and for the paper feed mechanism. Further, and especially because of the comparatively narrow width of the paper strip on which a receipt or other such document is being printed, the traverse mechanism for the printing cartridge makes many scans back and forth across the narrow width of the document as the paper is advanced. In this way, the speed of the printer is kept at a slow pace because so much time is spent in stopping and starting the print cartridge at the ends of these plural scans across the narrow paper strip.

It would be an advantage if a thermal inkjet printer could be provided that reduced or eliminated the many scans of a print cartridge back and forth across a narrow print media strip, such as a receipt strip cut from a roll of paper.

It also would be an advantage if a thermal inkjet printer could be provided that did not require precise movements of the print media advance mechanism. That is, if print media could be advanced in a step-wise motion by a low-precision stepping mechanism then such a thermal inkjet printer could be provided to the public at a much reduced cost.

SUMMARY OF INVENTION

In view of the deficiencies of the related technology, an object for this invention is to reduce or overcome one or more of these deficiencies.

The present invention provides a thermal inkjet printer could be provided that reduced or eliminated the many scans of a print cartridge back and forth across a narrow print media strip.

According to one aspect, the present invention provides a thermal inkjet printer in which a print cartridge is scanned lengthwise of an elongate strip of print media, in the same direction as print media advance, and all printing by the cartridge is accomplished during a printing interval with the print media stationary and the print cartridge progressing lengthwise of the print media.

According to another aspect of the present invention, such a thermal inkjet printer provides for printing a document having a width which is greater than the print head of the print cartridge by stepping the print cartridge laterally between printing intervals by a distance about equal to the print head width. In a next-subsequent printing interval, the print cartridge again progresses lengthwise of the print media to accomplish printing.

The present invention also provides a thermal inkjet printer that does not require precise movements of the print media advance mechanism.

Further to the above, the present invention provides such a thermal inkjet printer in which the print media is advanced in step-wise fashion between printing intervals, and is advanced by a unit length in the direction of the paper length (i.e., in the direction of the length of paper from a roll, for example). During printing intervals, the paper is stationary, and the paper advancing mechanism may operate with a relatively low precision.

According to one embodiment, the present invention provides a thermal inkjet printer comprising a housing defining a print media transport path defining a print media transport direction and having an exit; a print media transporter controllably moving a planar flexible print media in the transport direction from a supply thereof along the print media transport path and to the exit; an inkjet printing cartridge having an array of plural fine-dimension printing orifices, the inkjet printing cartridge during a printing interval controllably ejecting droplets of printing fluid from selected ones of the plural printing orifices and onto the print media; and carriage means controllably moving the printing cartridge in a direction substantially parallel to the print media transport direction and closely spaced to the print media.

According to another aspect, this invention provides a method of printing on elongate planar flexible media, the method comprising steps of: transporting print media unidirectionally along a path in a media transport direction; moving a inkjet printing cartridge proximate to the print media in a direction substantially parallel with the print media transport direction; and during movement of the printing cartridge relative to the print media controllably ejecting droplets of printing fluid from the printing cartridge and onto the print media.

Other objects, features, and advantages of the present invention will be apparent to those skilled in the pertinent arts from a consideration of the following detailed description of a single preferred exemplary embodiment of the invention, when taken in conjunction with the appended drawing figures, which will first be described briefly.

BRIEF DESCRIPTION OF THE DRAWING FIGURES

Figure 2:
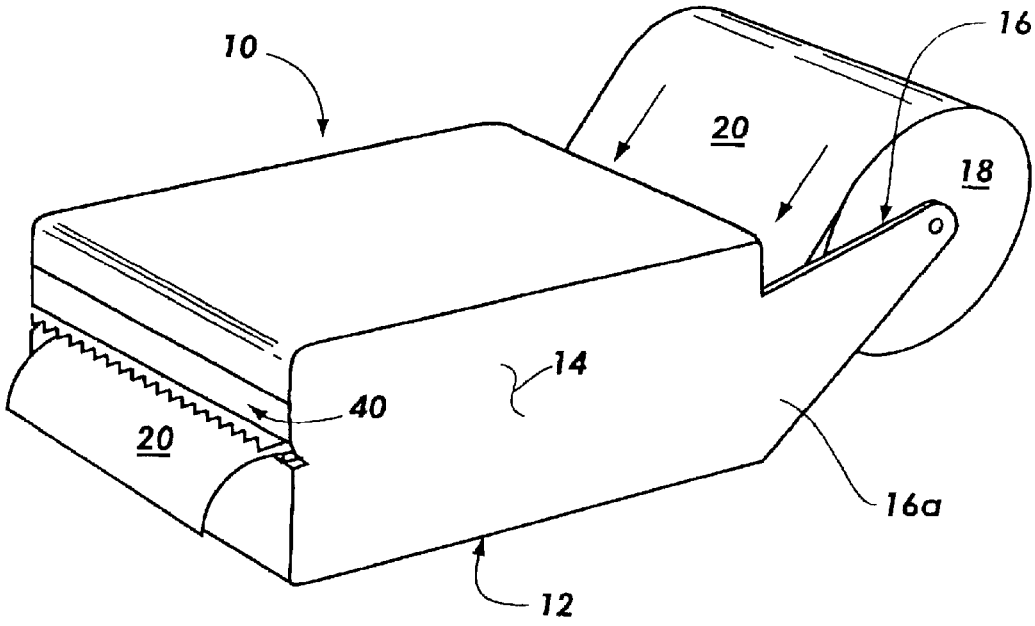
Figure 3A:
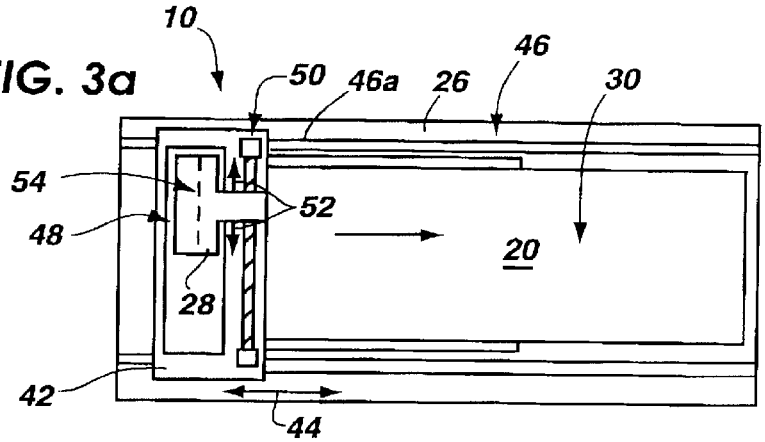
Figure 3B:
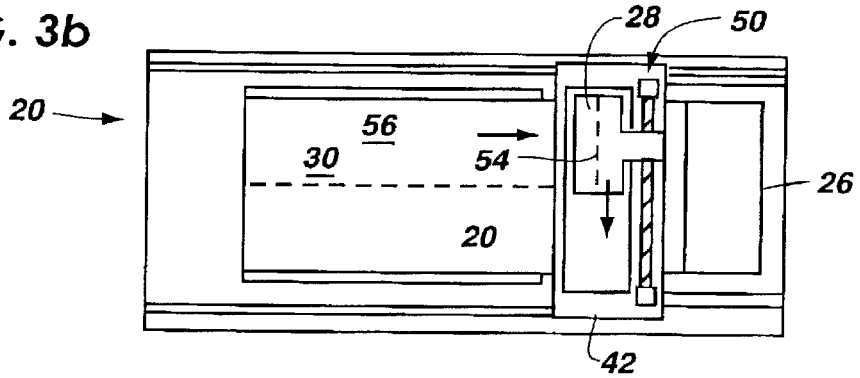
Figure 3C:
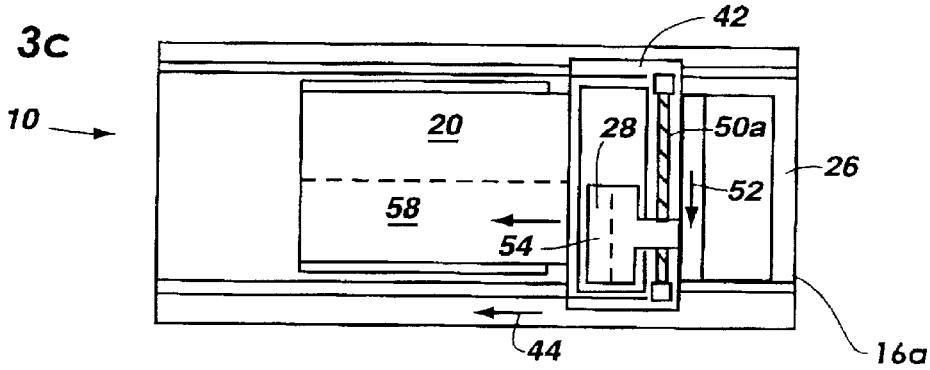
Figure 3D:
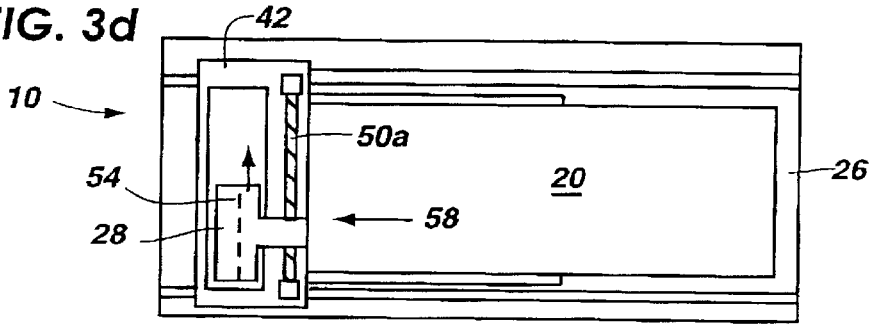
Figure 3E:
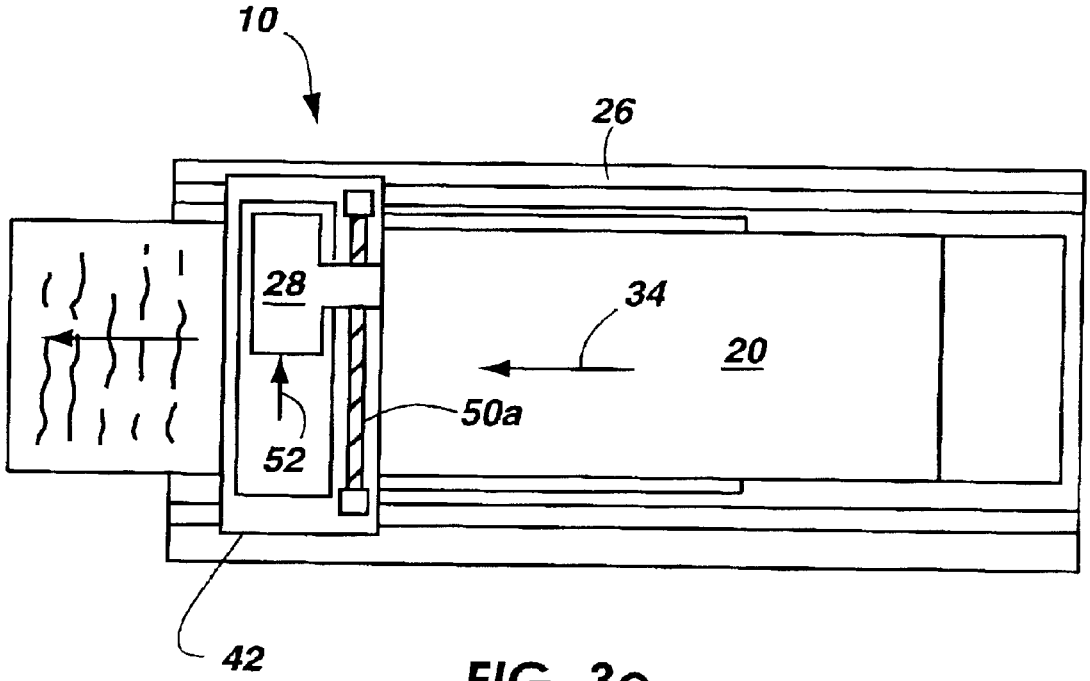
Figure 4:
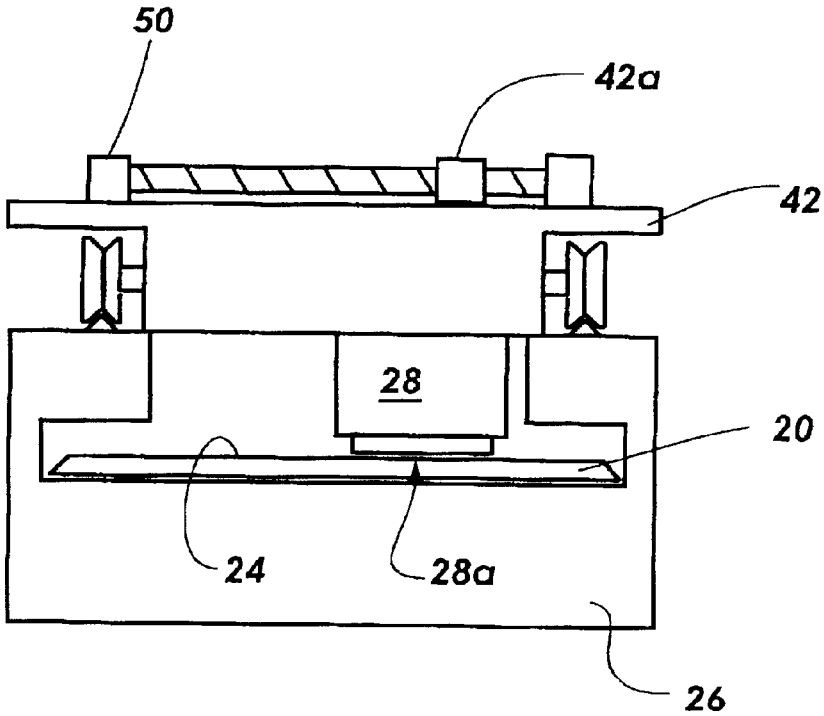

FIG. 1 is a highly diagrammatic side elevation view of a thermal inkjet printer embodying the resent invention;

FIG. 2 provides a perspective view of the exemplary thermal inkjet printer seen in FIG. 1;

FIGS. 3*a,* 3*b,* 3*c,* 3*d,* and 3*e* provide highly diagrammatic plan views of a portion of the thermal inkjet printer seen in FIGS. 1 and 2, with portions of the printer broken away for clarity of illustration of internal components and functions of the printer, and with each Figure showing a successive step in the process of printing a document; and FIG. 4 provides an exemplary end elevation view of the thermal inkjet printer seen in FIGS. 3, and is shown during a selected one of the steps of the printing process.

DETAILED DESCRIPTION OF A PREFERRED EXEMPLARY EMBODIMENT OF THE INVENTION

Referring now to the drawing Figures in conjunction with one another, and particularly to FIG. 1, this Figure shows an exemplary inkjet printer 10 embodying the present invention. This printer 10 includes a base 12 carrying a housing 14. The housing 14 has provisions 16 (i.e., in this case, a pair of spaced apart and outwardly extending arms 16*a*) for rotationally carrying a roll of paper 18, while allowing this roll of paper to pay off a paper strip 20. The paper strip 20 passes into the housing 14 via an entrance slot 22. The housing 14 may include a pair of opposed paper guide rollers 22*a* associated with the entrance slot 22 in order to better establish the plane of paper strip 20 within the printer 10. Those ordinarily skilled in the pertinent arts will also recognize that the provision 16 for supporting and paying off the paper strip 20 from roll 18 is merely exemplary and that other various construction expedients may be utilized to store and pay out the paper 20 from roll 18. For example, the housing 14 may include a storage chamber enclosing paper roll 18. Alternatively, the roll 18 of paper may be allowed to simply lay in an arcuate tray, and slide rotationally in this tray as the strip 20 pays out.

Considering FIGS. 3 also, it is seen that within the housing 14 and entrance slot 22 is a printing platen 24 across which the paper strip 20 moves in opposition to a printer frame 26. This printer frame 26 is elongate in the direction of the length of paper strip 20, and carries a thermal inkjet print cartridge 28 for controlled printing movements relative to the paper strip portion which is atop of printing platen 24 and within the length of printer frame 26. This part of the paper strip 20 within the frame 26 define a "printing field," or "printing area" (further described herein below). As those ordinarily skilled in the pertinent arts will understand, the inkjet print cartridge 28 includes a print head (indicated with arrowed numeral 28*a*) having a generally linear array of fine-dimension printing orifices (not seen in the drawing Figures). The length of the linear array of printing orifices on print head 28*a* is arranged perpendicularly to the length of paper strip 20. During a printing interval selected ones of the printing orifices eject fine-dimension droplets of printing fluid (i.e., ink) onto the paper 20 upon the platen 24. As will be further described, the print cartridge is movable over the paper 20 on platen 24 so that printing can be carried out any where on this part of the paper 20 (i.e., within the printing field). Thus, it is appreciated that the platen 24, and the area within which print cartridge 28 is controllably movable over the paper 20 on the platen 24, defines a printing area which is indicated with arrowed numeral 30 in FIG. 1, and in FIG. 3.

Beyond the printing platen 24 and printer frame 26 (i.e., in the direction of movement of paper strip 20) is a feed mechanism (i.e., a pinch roller capstan) 32 for controllably moving the paper strip 20 along a printing path (indicated by arrowed numeral 34) extending between the entrance slot 22 and an exit slot 36. Preferably, the capstan 32 is a "step-function" type of device, which advances the paper strip 20 by a unit length along the printing path (movement indicated by arrowed numeral 34) each time this paper feed device or capstan is "triggered" to operate. Thus, the capstan 32 may be a relatively simple and low precision device, which according to one embodiment of the invention, simply "steps" the paper strip 20 forward along path 34 in increments that are each substantially equal to the length of the printing area 30. The documents printed by this embodiment of the printer 10 will be integer multiples (i.e., 1 unit, or greater in whole-number units) of the length of the printing area 30. Alternatively, the unit dimension of print media advancement by the capstan 32 may be less than the length of the printing area 30. In that case, the documents printed by the printer 10 may be less than or greater than the length of the printing area 30, in multiples of the unit dimension of print media advancement.

Intermediate of the capstan 32 and the exit slot 36 the printer 10 may include a cutter device 38 for separating a printed portion of the strip 20 after this printed portion has been advanced out of the exit slot 36 by the capstan 32. Alternatively, the housing 14 may simply carry a serrated cutter bar (indicated by arrowed numeral 40) disposed at the exit slot for allowing a user of the printer 10 to tear free of the strip 20 the printed documents produced by this printer.

Considering now in greater detail FIGS. 3*a* through 3*e,* along with FIG. 4, and viewing first FIG. 3*a,* it is seen that this Figure provides a plan view of the printer frame 26 portion of printer 10. In other words, the FIGS. 3 do not show the entire printer 10 in plan view, but only that portion at frame 26. In FIG. 3*a,* the printer 10 is in the condition it first has preparatory to printing a document on the paper 20 within printing area 30. As is seen in FIG. 3*a,* the elongate printer frame 26 carries a shuttle frame 42 for movement longitudinally of the paper strip 20, as is indicated by double headed arrow 44. The printer 10 includes a shuttle frame drive device 46 for controllably moving the shuttle frame 42 longitudinally along the printer frame 26 (i.e., selectively in both directions—rightwardly and leftwardly viewing FIG. 3*a*). As is illustrated in the FIGS. 3, the shuttle frame drive device may include a flexible cable 46*a* attached to the frame 42 and trained over sheaves (not seen in the drawing Figures) located at opposite ends of the frame 26. A motor drive (not shown) controllably pulls the shuttle frame 42 along the frame 26, as is indicated by arrows 44. The motor drive may include a rotary encoder for providing position signals indicative of the position of shuttle frame 42 along frame 26. Alternatively, a linear encoder (code strip and sensor) may be used for this purpose. Those ordinarily skilled in the pertinent arts will appreciate that this disclosed arrangement for moving and sensing the position of shuttle frame 42 is only one of a great multitude of alternatives that are available for performing this function. The present invention is not limited to the particular alternative disclosed for this function of movement of shuttle frame 42 along print frame 26.

The shuttle frame 42 movably carries a carriage 48 in which the print cartridge 28 is received. This carriage 48 may be dithered laterally of the paper strip 20 between either one of two possible positions, one of which is seen in FIG. 1 (and in FIGS. 3*a* and 3*b;* the alternative position being seen in FIGS. 3*c* and 3*d*). On the shuttle frame 42, the printer 10 includes a carriage drive device 50, which selectively positions the carriage 48 in either one of its two operative positions, as is indicated by double headed arrow 52. The drive device 50 is a bi-stable type of drive, and dithers the carriage 48 laterally between stable positions in either one of two possible positions. In the preferred embodiment, the drive device 50 is depicted as utilizing a jack screw 50*a,* engaged into a lug 48*a* of the carriage. The jack screw 50*a* is depicted as having a fast pitch jack screw thread so that rotation of this jack screw by a drive motor (not seen in the drawing Figures) quickly moves the carriage laterally between its two operative positions.

Alternatively, those skilled in the pertinent arts will appreciate that a variety of other moving and positioning expedients are available for moving the carriage 48 and positioning it in its operative positions. For example, a linear solenoid may be used to move the carriage 48 laterally. Alternatively, a drive cable or drive belt similar to drive 46 described above may also be used to laterally move and position the carriage 48. It will be further understood that although the invention is not so limited, the exemplary preferred embodiment of the invention as presented by the printer 10 has only two alternative lateral positions for the carriage 48. In this case, the carriage drive device 50 may be a bi-stable driver (such as a solenoid actuator with a spring-loaded detent, for example) for retaining the carriage 48 in each one of its two alternative positions on shuttle frame 42.

Alternative embodiments of the printer 10 may have carriages with more than two operative lateral positions. Further alternatively, the carriage drive device may be a servo-type actuator, such as a stepper motor and jack screw device, with limit switches or latching devices, for example, being used to determine the positioning of the carriage at one of its two alternative positions, as well as providing for selective retention of the carriage at these positions.

As is seen in FIG. 3*a,* the shuttle frame 42 and carriage 48 with print cartridge 28 are positioned preparatory for the shuttle frame to move rightwardly from the position of FIG. 3*a* to the position of FIG. 3*b* (recalling movement arrow 44). As those ordinarily skilled in the pertinent arts will understand, the print head 28*a* of the print cartridge 28 includes one or more laterally extending (i.e., extending laterally of the paper 20) rows or lines of printing orifices (represented by line 54 in FIGS. 3). During a printing interval, ink or other printing fluid is controllably ejected from these orifices in order to form characters and images on the paper 20 within the printing area 30. In view of the fact that the carriage 48 carries the print cartridge 28 longitudinally over the paper 20, and the line 54 of print orifices extends perpendicularly to this longitudinal direction, it is seen that the movement of print cartridge 28 from the position of FIG. 3*a* to that of FIG. 3*b* allows the print cartridge to print in a first longitudinally extending "swath", indicated with the numeral 56 (i.e., longitudinal with respect to the length and direction of advance of paper 20 along printing path 34). It is noted that swath 56 is on the right hand side of strip 20 looking in the direction of advance of strip 20 through the printer 10. During the first printing interval in which swath 56 is printed, the paper 20 is held stationary on the platen 24 in the print area 30 by the capstan 32 as the print cartridge 28 is controllably scanned lengthwise of the paper 20.

Upon the carriage 48 reaching the position indicated in FIG. 3*b,* the first print swath 56 will have been printed. However, in this case, the paper 20 in print area 20 is substantially twice as wide as the lateral length of the line 54 of orifices (i.e., substantially twice as wide as swath 56). Accordingly, the carriage drive device 50 is employed to dither the carriage 48 from the position seen in FIG. 3*b* to that seen in FIG. 3*c* (movement depicted by arrow 52 in FIG. 3*c*). With the carriage 48 positioned as seen in FIG. 3*c,* the printer 10 is prepared to print in a second "swath" 58 also extending longitudinal of the paper strip 20 and defining the other half of the printing area 30. Swath 58 is on the left hand side of paper strip 20, looking in the direction of paper advance through the printer 10. In order to print in the second swath 58, the carriage 48 and print cartridge 28 are controllably scanned in the longitudinal direction from the position seen in FIG. 3*c* to that of FIG. 3*d*. At the completion of this printing interval, the swath 58 will have been printed. During this printing interval, the paper strip 20 is also held stationary on platen 24 by capstan 32.

After both printing swaths 56 and 58 are printed, the document being printed on paper strip 20 within printing area 30 may be partially or fully completed, in which case it is advanced partially or fully out of exit slot 36 using capstan 32, and if fully printed is cut off using cutter device 38 or cutter bar 40. In the case of a fully printed document the paper strip 20 will be advanced by a distance somewhat longer than the length of printing area 30. This advancing of the paper strip 20 is illustrated in FIG. 3*e,* and the printed characters on the document are represented by squiggles on the paper. It will be noted that a fresh area of paper strip is simultaneously brought into the printing area 30. In the case of the document not being fully printed by the printing operation described above, then the paper strip 20 is advanced by capstan 32 a unit distance equal to the length of printing area 30, and the printing operation can be completed again to produce documents of any length in integer multiples of the unit length (i.e., the length of printing area 30). As noted above, the present invention is not limited to advancement of the print media in unit lengths that are equal to the length of the printing area 30. In such a case, the unit dimensions by which the capstan 32 advances the paper strip 20 may be quite small, and documents of integer multiples of this smaller dimension may be printed using printer 10.

While the paper strip 20 is being advanced from the exit slot 36 by use of capstan 32, the carriage drive device 50 may be employed to dither the carriage 48 back to the position seen in FIG. 3*a.* This dithering of the carriage 48 and print cartridge 28 returns the printer 10 to the position seen in FIG. 3*a,* and readies the printer for a repeat of the printing operation described above.

Alternatively, the carriage 48 may be maintained in the lateral position of FIG. 3, and the next successive printing operation will commence with the carriage on the "left hand" side of the paper. The return scan of the carriage 48 would thus be conducted on the "right hand" side of the paper, with the carriage dithering between left hand and right hand sides of the paper strip 20 only with the shuttle frame 42 in the position of FIGS. 3*b* and 3*c.*

Still alternatively, and as alluded to above, a document may include integer multiples of the length of printing area 30, so that after the swaths 56 and 58 are printed with a first part of the document, the paper strip is advanced a distance substantially equal to the length dimension of printing area 30, and the printing process outlined above is repeated. This simplifies the capstan device 32 because it need advance the paper strip 20 only in a selected multiple of a selected advance length. If the document is completed, then the capstan 32 advances is a length equal to the length of the printing area 30, plus a "margin" length. The margin length allows the document to have a selected length of top and bottom margin in addition to an integer multiple of unit lengths in which the printing is performed (i.e., which may be an integer multiple of the length of printing area 30). On the other hand, a document may have a length that is greater than or less than the unit length of printing area 30 by arranging the capstan 32 to advance the paper in smaller unit lengths or steps, or in steps that are a selected fractional part of the length of printing area 30.

The present invention also contemplates printing documents having a width only a single multiple of the line length 54, and also of printing documents that have a width which is plural multiples of the line length 54. The present exemplary embodiment of the invention provides a printer 10 that prints a document that is twice the width of line 54, but the invention is not so limited. It will be noted that because during a printing interval the print cartridge 28 is scanned along a length dimension of the printed document, rather than across the width of the document, the number of stops and starts for the print cartridge scanning movement is reduced in comparison to a printer scanning the print cartridge across the width of a paper. Accordingly, the time period required to print a document with the present invention is reduced in comparison to conventional inkjet printers having a moving print cartridge.

Further, it is to be noted that the capstan device 32 can be a relatively low-precision device that advances the paper strip 20 in step-wise manner. Those ordinarily skilled in the pertinent arts will understand that for low-cost, high-volume of transaction receipts, for example, the exact registry of adjacent portions of such a "multiple length" document is not of much importance. Further, the transaction receipt possibly can be arranged so that no part of the printing crosses from one area of printing to the next, and imprecision in registry of the advanced lengths of paper will not be apparent. Further, for this type of printing application, a registry of a selected fraction of a character height or length is acceptable even if characters must cross the boundaries of successive printing areas of a document. Such low precision of the advance distances for paper strip 20 by capstan 32 are easily and inexpensively obtained. For example, the capstan 32 may employ inexpensive stepper motor technology.

Similarly, the carriage drive device 50 may be a step-function device, dithering the carriage 48 between (or among) its possible lateral positions along the shuttle frame 42 between printing intervals. It is an advantage of the present invention that only the shuttle frame drive device 46, which moves shuttle frame 42 lengthwise of the paper strip 20 during a printing interval, needs to provide a controlled level of precision movement. This controlled level of precision for the movement of shuttle frame 42 is also easily obtained with stepper motor technology.

It is an advantage of the present invention that a printer having a moving inkjet printing cartridge is provided, and which moves the cartridge lengthwise of the paper and parallel to the direction of paper advance through the printer during a printing interval. The speed of printing and reduced complexity and cost of this inventive printer were heretofore unavailable in the art.

Further to the above, those skilled in the pertinent arts will further appreciate that the present invention may be embodied in other specific forms without departing from the spirit, scope, or central attributes of the invention. Because the foregoing description of the present invention discloses only a particularly preferred exemplary embodiment of the invention, it is to be understood that other variations are recognized as being within the scope of the present invention. Accordingly, the present invention is not limited to the particular embodiment which has been described in detail herein. Rather, reference should be made to the appended claims which define the spirit and scope of the present invention.

What is claimed is:

1. A swath printer comprising:

a housing defining a print media transport path and a print media transport direction, the print media transport path having an exit, a print media transporter controllably moving print media from a supply thereof in said transport direction along said print media transport path and to said exit;

an inkjet printing cartridge having an array of printing orifices for controllably ejecting printing fluid from selected ones of said printing orifices during a printing interval onto said print media held in a stationary position during said printing interval; and carriage means controllably moving said printing cartridge forwardly or rearwardly in a direction substantially parallel to said transport direction during said printing interval to print one or more swaths of characters and images on the print media.

2. The printer of claim 1 wherein said inkjet printing cartridge includes an array of printing orifices extending in a direction substantially perpendicular to said transport direction to define a swath width on the media.

3. The printer of claim 1 wherein said cartridge means includes a driver for moving said printing cartridge laterally relative to said transport direction between two or more fixed printing positions during a non-printing interval in order to print swaths which are in different lateral positions on the media.

4. The printer of claim 3 wherein said driver for moving said print cartridge laterally relative to said print media transport direction is a bi-stable driver having at least two laterally spaced positions for said printing cartridge in order to print non-overlapping swaths on the media.

5. A method of operating an inkjet swath printer, said method comprising:

defining a print media transport path in a forward direction through a print zone, transporting print media from a source thereof controllably along said print media transport path in said forward direction;

providing an inkjet printing cartridge having an array of plural printing orifices;

controllably ejecting printing fluid from selected ones of said printing orifices and onto print media to form characters or images during a printing interval while the print media is in a stationary position in the print zone;

controllably moving said printing cartridge in proximity to said print media during said printing interval in a scanning direction substantially parallel to said transport direction to create a first printing swath on a portion of the media in the print zone; and subsequently advancing the print media in said forward direction during a non-printing interval to transport said first printing swath outside of the print zone.

6. The method of operating an inkjet printer according to claim 5 further including:

providing said array of plural printing orifices in a generally linear arrangement extending substantially perpendicular to said forward direction to define a swath width on the media.

7. The method of operating an inkjet printer according to claim 6 further including creating the first printing swath during a movement in a first scanning direction of said printing cartridge relative to said stationary print media, and creating a second printing swath during movement in a second opposite scanning direction of said printing cartridge relative to said print media.

8. The method of operating an inkjet printer according to claim 5 further including relocating said print cartridge laterally relative to said transport direction during a non-printing interval to create a second printing swath during forward or rearward movement of said printing cartridge relative to said stationary print media in said scanning direction substantially parallel to said print media transport direction.

9. A method of printing on an elongate strip of print media comprising:

transporting the elongate strip in a direction of its length forwardly through a printing area along a transport path;

moving a printing cartridge in a scanning direction substantially parallel with said transport path;

creating a first printing swath of markings on the strip during forward or rearward movement of said printing cartridge relative to said print media in the scanning direction by holding the strip in a stationary position in the printing area during a print interval while controllably activating said printing cartridge; and relocating said printing cartridge laterally relative to said transport path during a non-printing interval to create a second printing swath which is laterally displaced from the first printing swath.

10. The method of printing according to claim 9 further including an array of printing elements extending in a direction generally perpendicular to said transport path to define a swath width for the first and second printing swaths.

11. The method of printing according to claim 9 wherein relocating said print cartridge laterally includes providing at least two laterally spaced positions in which said printing cartridge is maintained in selectively-stable fashion for printing forwardly or rearwardly in said scanning direction during a printing interval in each position.

12. A swath printer comprising:

a base carrying a housing;

an elongate printer frame disposed within said housing and having a length dimension, said printer frame defining an elongate printing platen in a media transport path;

advance means to supply elongate print media for movement unidirectionally along said transport path through a printing area during a printing interval;

a shuttle frame movable longitudinally along said printer frame generally parallel to said transport path, said shuttle frame having provision for carrying a printing cartridge having an array of printing elements aligned generally perpendicular to said media transport direction to define a swath width on the print media; and wherein one or more swaths of markings are applied to stationary media in the printing area during forward or rearward movement of said shuttle frame during printing intervals.

13. The printer of claim 12 wherein said shuttle frame movably carries a carriage for carrying said printing cartridge, said carriage being movable generally laterally of said print media transport direction on said shuttle frame during non-printing intervals between two or more laterally displaced printing positions.

14. The printer of claim 12 wherein said advance means is a unit-step-advancement device controllably advancing said print media relative to said printer in steps of unit dimension.

15. The printer of claim 14 wherein said advance means selectively moves said print media forwardly along said printing path by a unit dimension which is substantially equal to the length dimension of said printing area.

* * * * *